PM018 XR 4,255,806

United States Patent [19]

Fahrenschon et al.

[11] 4,255,806

[45] Mar. 10, 1981

[54] DISPLAY MEANS FOR CHRONOMETERS WITH ELECTRO-OPTICAL ELEMENTS

[75] Inventors: Kurt Fahrenschon, Kelkheim; Friedrich W. Nickol, Eppstein, both of Fed. Rep. of Germany

[73] Assignee: Braun Aktiengesellschaft, Frankfurt am Main, Fed. Rep. of Germany

[21] Appl. No.: 10,643

[22] Filed: Feb. 8, 1979

[30] Foreign Application Priority Data

Feb. 10, 1978 [DE] Fed. Rep. of Germany ..... 2805646

[51] Int. Cl.[3] ..... G04C 17/02

[52] U.S. Cl. ..... 368/240; 368/241; 368/242; 368/82; 368/83; 368/84

[58] Field of Search ..... 58/127 R, 23 R, 50 R; 340/784, 765; 350/333, 336; 368/82–84, 240–242

[56] References Cited

U.S. PATENT DOCUMENTS

| | | | |
|---|---|---|---|
| 3,772,874 | 11/1973 | Lefkowitz | 58/50 R |
| 3,959,963 | 6/1976 | Murrell | 58/127 R X |
| 3,969,887 | 7/1976 | Fukumoto | 58/50 R |
| 3,987,617 | 10/1976 | Slob | 58/50 R |
| 3,992,875 | 11/1976 | Kashio | 58/127 R X |
| 4,079,369 | 3/1978 | Fukumoto | 58/50 R X |
| 4,081,953 | 4/1978 | Crutcher | 58/127 R X |
| 4,095,405 | 6/1978 | Tanaka | 58/50 R X |
| 4,095,414 | 6/1978 | Reich | 58/50 R |

*Primary Examiner*—Ulysses Weldon

*Attorney, Agent, or Firm*—Sprung, Felfe, Horn, Lynch & Kramer

[57] ABSTRACT

A display for an electronic timepiece or the like has an analog electro-optical display comprising a plurality of segment electrodes radially disposed about a center point and at least one first counterelectrode each bridging at least two radial segment electrodes and a digital electro-optical display comprising a plurality of digital electrodes which define at least one alphanumeric character and at least one second counterelectrode. By using at least two first counterelectrodes each having a different set of radial segment electrodes associated therewith and electrically connecting at least one radial segment electrode of one set in parallel with one radial segment electrode of the other set and in parallel with one digit electrode, the display may be driven in a time multiplex manner with a minimum number of external display connections.

9 Claims, 9 Drawing Figures

FIG. 7
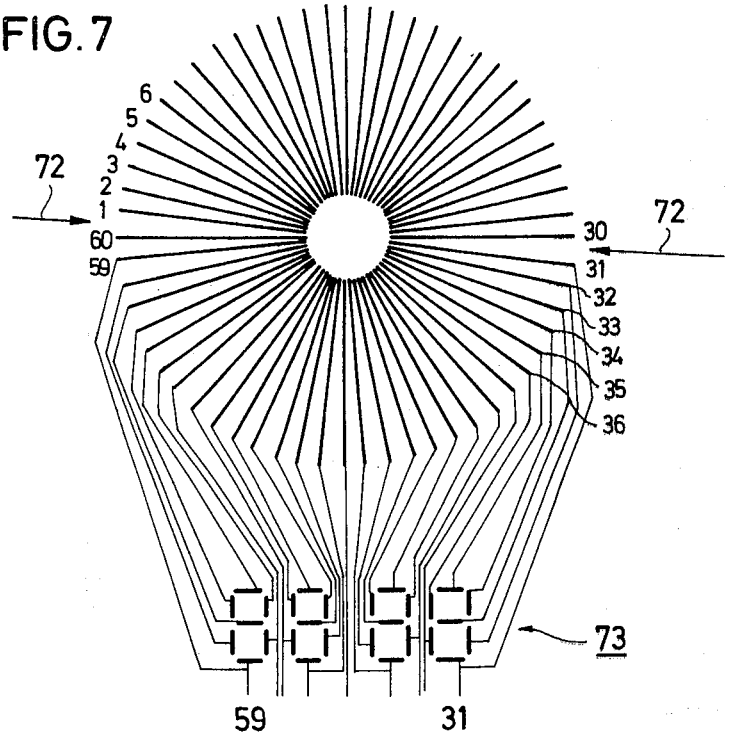
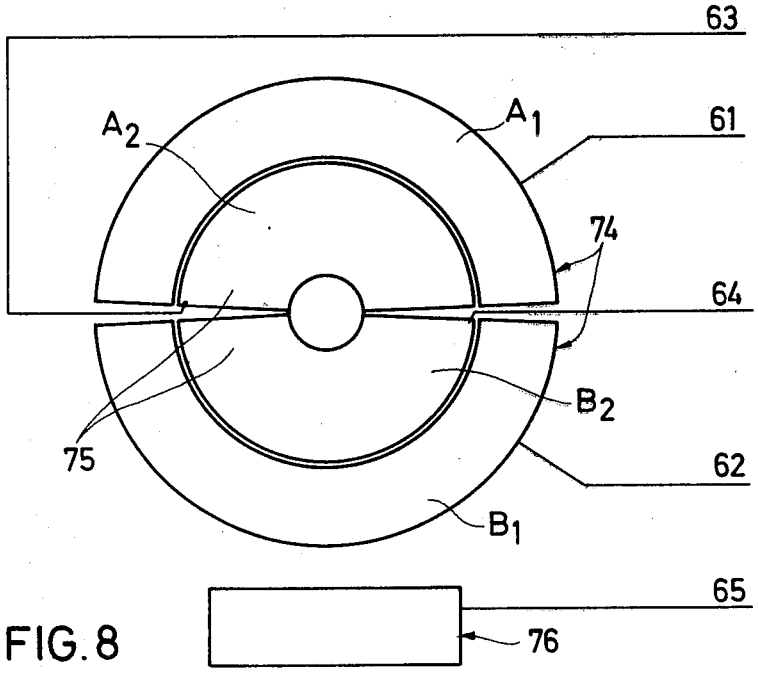
FIG. 8

DISPLAY MEANS FOR CHRONOMETERS WITH ELECTRO-OPTICAL ELEMENTS

The invention relates to a display means, preferably for chronometers with electro-optical elements, in particular with a liquid-crystal system, consisting of an analog display with a plurality of strip like electrodes, arranged radially about a center point, with which at least one counterelectrode arrangement bridging more than two radial electrodes is associated, its extension corresponding to the position of the radial electrodes, and of a digital display with a plurality of electrodes which make up at least one symbol and with which at least one further counterelectrode arrangement is associated, its extension corresponding to the position of the symbol electrodes, some of the radial electrodes being connected in parallel with the symbol electrodes.

Chronometers with electro-optical digital display of the time and optionally of the date have been commercially available for a fairly long period. However, they lack the property of clocks and watches having hands, i.e. that of immediately enabling the indicated time to be related, at a glance, to the beginning and/or end of a period of time. A calculation always has to be carried out in the mind of the user, whereby the time already elapsed or the time that is to elapse before a given point in time is reached has to be calculated. To eliminate this disadvantage, display means for chronometers have been disclosed, that comprise an analog time display as well as digital reproduction of the date or other information.

U.S. Pat. No. 3,969,887 discloses a chronometer with an analog display of hours, minutes and, in some cases, seconds by means of standard face elements. With the aid of 60 radially extending strip electrodes arranged in rings and 12 inwardly disposed display segments, it is possible to provide a time display with 36 connections. A disadvantage of this system resides in the fact that the analog display of the hours can be observed only with relative difficulty, and that an additional digital display is not provided, and indeed cannot be, without considerable difficulty.

A display means has also been proposed wherein a counterelectrode arrangement for the analog display consists of two concentric circles, and wherein symbol electrodes and some of the radial electrodes are connected in parallel. The two annular electrodes offer the advantage that different "hand lengths" can be represented in the analog display, so that the indication of hours and minutes appears to correspond roughly to the display provided by clocks and watches having hands. However, the entire arrangement requires at least 63 electrical connections—60 connections to the radial electrodes and three connections to the counterelectrodes.

A further display means has been proposed wherein electrodes and counterelectrodes each consist of 30 radial strip electrodes which, in the circumferential direction, are offset by half the width of an electrode so that an inter-digital arrangement is formed. The strip electrodes that make up the counterelectrode arrangement are alternately connected to an inner and an outer annular lead. In this way it is possible, using 36 outer connections, to provide an analog display as well as a digital display. However, the problem of running the leads to the individual electrodes is extremely complicated.

Furthermore, it is not possible to represent short and long strips in the analog display, since further radial division of the counterelectrode arrangement is not feasible. In order to differentiate the hour display from the minute display, it has therefore been proposed, for example, to switch in simultaneously a plurality of strip electrodes for displaying the hour, so that a broader block appears in the display. A display of this kind consequently deviates from the display provided by a normal clock or watch having hands.

It is the object of the present invention to provide a display means of the type described above and incorporating analog and digital indication, wherein the analog display largely resembles the usual picture provided by clocks or watches having hands, and wherein only a small number of external electrical connections for the drive and control circuitry of the chronometer is necessary.

In accordance with the invention, this object is accomplished, in the display means described above, in that the counterelectrode arrangement of the radial electrodes is divided into at least two equal-sized sectors $A_1$ and $B_1$, and $A_2$ and $B_2$; that at least one of the radial electrodes associated with one of the sectors, $A_1$ or $A_2$, is electrically connected in parallel with at least one of the radial electrodes associated with the other sector or sectors, $B_1$ or $B_2$; and that the symbol electrodes are likewise electrically connected in parallel with at least two parallel-connected radial electrodes.

In conjunction with a drive and control circuit for chronometers of known kind and which operates on the time multiplex system with a ratio of 1:3, the number of external connections can be considerably reduced, for example, to 35 in the case of an analog display with a four-place digital display. The display means already includes a digital display while, as regards the presentation of the display, it largely resembles that of a normal clock or watch having hands. The leads can be accommodated in a simple manner, and the digital display can be arranged both within and outside of the analog display.

The minimum number of connections is largely determined by the number of symbol electrodes in the digital display. One of the usual digital displays contains four places (digits) each with seven symbol electrodes if, for example, the date is to be displayed. Thus, the digital display contains a total of 28 symbol electrodes with the associated electrical connections which, however, as stated above, are connected to in parallel with some of the radial electrodes so that no additional external connections result.

Because of the division of the counterelectrode arrangement into several sectors, as proposed by the invention, together with the connection in parallel of corresponding radial electrodes, only one or other of the radial electrodes can lead to an indication each time the radial electrodes and the counterelectrodes are appropriately actuated. Since the method and means form part of the prior art as used in providing a display in a liquid crystal system, further explanation is not necessary. Division of the counterelectrode arrangement into two semicircular sectors leads to halving the number of the external connections for the radial electrodes, and only one additional connection is required for one of the sectors. In conjunction with a digital display with 28 symbol electrodes, division of the counterelectrode arrangement into two semicircular sectors represents the optimum, since thereby an acceptable situation is created wherein the necessary number of connections for the symbol electrodes is provided, i.e., the connections for the radial electrodes are practically all additionally used for the symbol electrodes. It is however readily possible to increase the number of sectors in the counterelectrode arrangement to three, four or more.

In accordance with a further feature of the invention and for the purpose of representing different "lengths of hands", the counterelectrode arrangement of the radial electrodes consists of two concentric circles which are divided into at least two equal-sized sectors $A_1$ and $B_1$, and $A_2$ and $B_2$ having the same angular position. By energizing the corresponding electrodes on the time multiplex principle, long as well as short "hands" can thus be represented, and furthermore, it is possible to indicate seconds if the time-multiplex ratio is raised 1:4. By division into two semi-circular sectors, the parallel connectionn of the radial electrodes is expediently so effected that diametrically opposite radial electrodes are connected in parallel electrically.

Embodiments of the invention, further advantages and variants will now be described in greater detail with reference to FIGS. 1 to 9, where:

Figure 1:
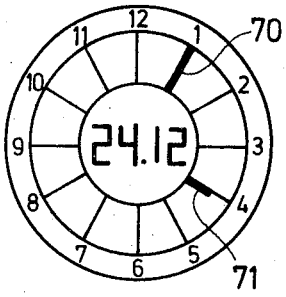
FIG. 1 is a plan view of a display unit embodying the invention having a circular periphery with a digital display within it.
Figure 2:
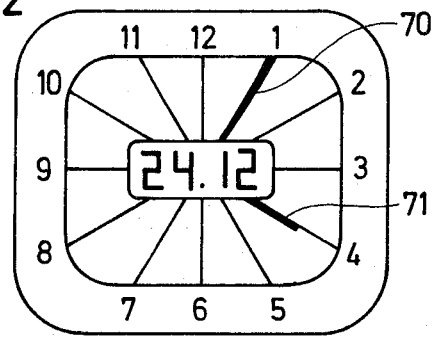
FIG. 2 is a plan view of a display means embodying the invention of substantially rectangular shape and a digital display within the rectangle.
Figure 3:
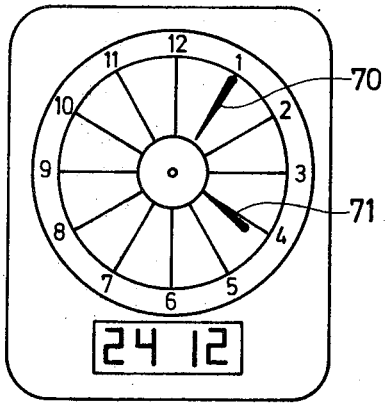
Figure 4:
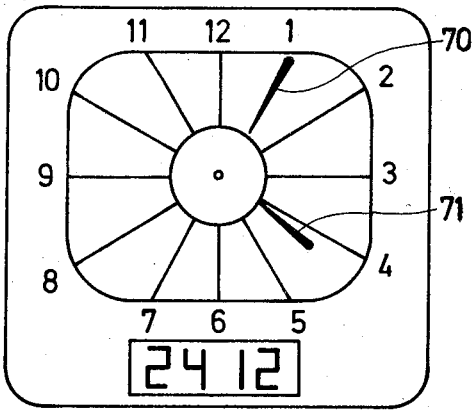
Figure 5:
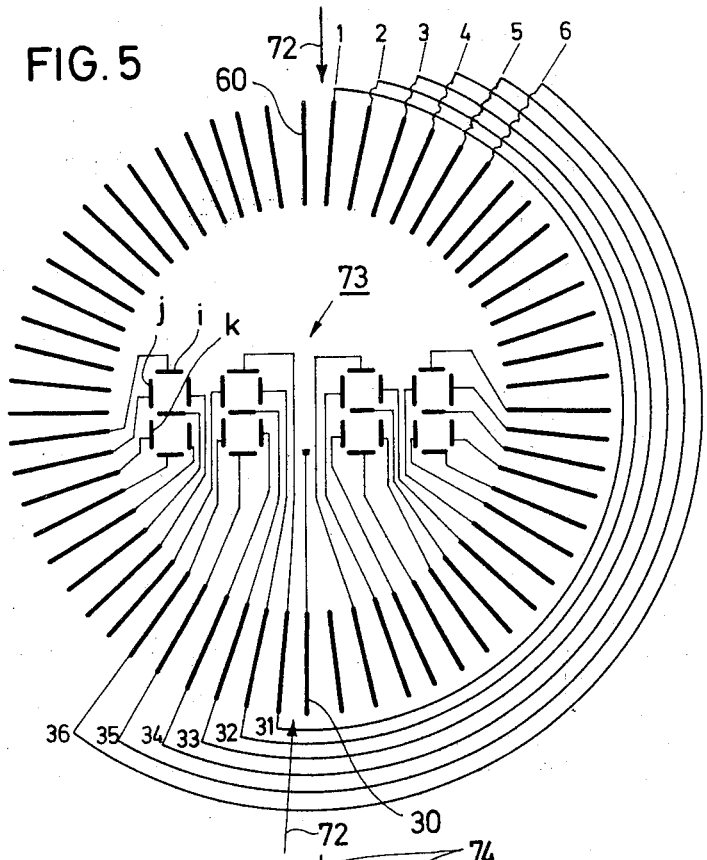
Figure 6:
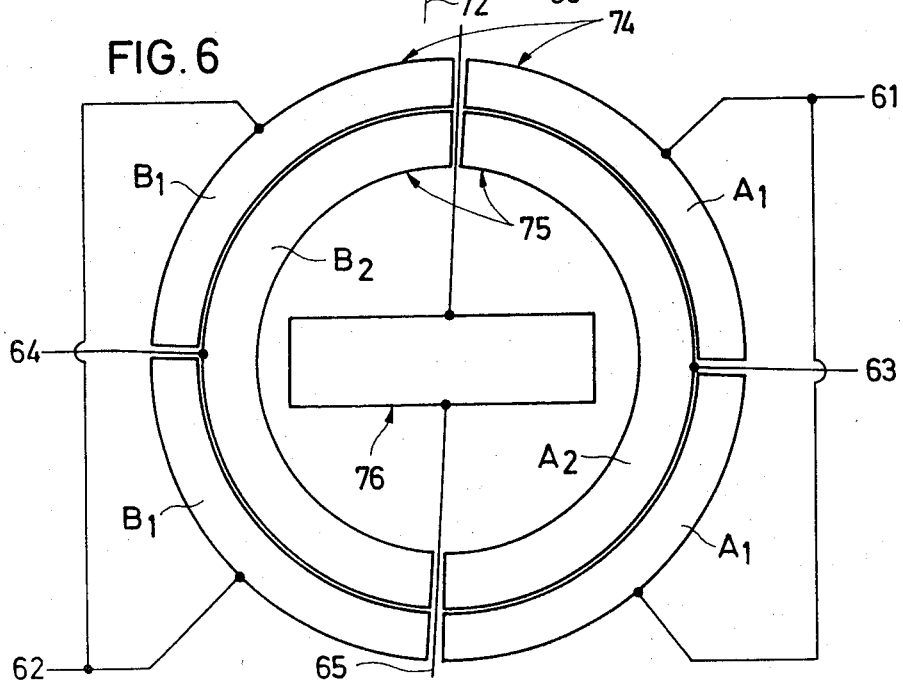

FIG. 3 shows a display means embodying the invention having a circular periphery as in FIG. 1, but with a digital display outside the circle, FIG. 4 is a plan view of a display means embodying the invention of rectangular form as in FIG. 2, but with the digital display outside the rectangle, FIG. 5 is a diagramatic representation of an arrangement of radial electrodes, symbol electrodes and their connections, as used, for example, for the display means of FIG. 1, FIG. 6 illustrates a counterelectrode arrangement for the means shown in FIG. 5, FIG. 7 is a diagramatic representation of radial electrodes, symbol electrodes and their external connections, as may be used, for example, in the display means of FIG. 3.

Figure 9:
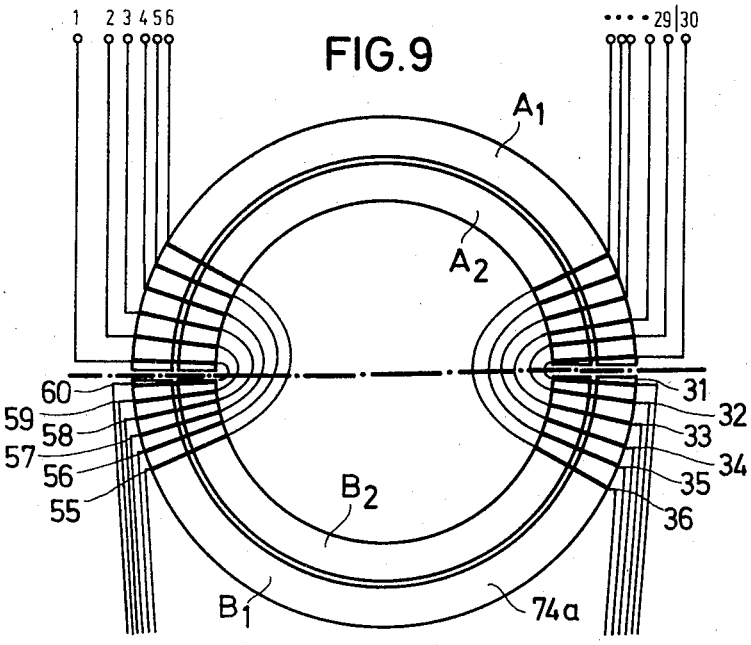

FIG. 8 shows a counterelectrode arrangement for the means shown in FIG. 7, and FIG. 9 shows the internal connection system of the radial electrodes of FIG. 7 on a different scale.

In FIGS. 1 to 4, the time 16.05 hours is represented on an analog basis by means of a long hand 70 and a short hand 71. The digital display gives the date 24th December.

Referring to FIG. 5, a total of 60 strip electrodes are arranged within a circle and radially of its center point, these being for the purpose of providing an analog indication of minutes and seconds. The radial electrodes are divided electrically into two blocks, i.e., into a block comprising the electrodes 1 to 30 and a further block comprising the electrodes 31 to 60. In FIG. 5, only the first six electrodes and the last electrode of a block carry a number in each case. By means of outer annular leads, the radial electrodes 1 and 31, 2 and 32 . . . n and (30+n) are interconnected respectively, so that a parallel circuit is created. The point of division between the two blocks, which cannot be detected by the eye, is indicated by the radial arrows 72. The division is between the radial electrodes 30/31 and 60/1. The position of electrode 1 can be selected as required.

Within the radial electrodes 1 to 60 is arranged a digital display 73 which comprises four places each of which has seven symbol electrodes. The symbol electrodes associated with the first place are designated i, j, k, . . . One of these symbol electrodes is connected, by way of inner leads, to a radial electrode 1 to 30 and is connected electrically in parallel therewith, i.e., when a radial electrode is energized, then because of the arrangement used, the diametrically opposite electrode as well as an associated symbol electrode simultaneously receive voltage. The arrangement shown in FIG. 5 requires only 30 outer leads. In this arrangement, two connections are free and can be used in the representation of further information.

Referring to FIG. 6, counterelectrode arrangements 74, 75 and 76 for the electrodes of FIG. 5 are illustrated, i.e., the counterelectrode arrangement 74 and 75 are in register with the radial electrodes 1 to 60, whereas the counterelectrode arrangement 76 is in register with the symbol electrodes i, j, k . . . of the digital display 73 in FIG. 5. The counterelectrode arrangement 75 is of circular form and lies within the counterelectrode arrangement 74 and can be energized separately from this electrically, so that the radial electrodes 1 to 60 can be used at choice to comprise an indication of complete or partial length depending upon whether voltage is applied to one or both of the counterelectrode arrangements 74 and 75.

The counterelectrode arrangement 74 is divided into two semicircular sectors $A_1$ and $B_1$, and the diametrically opposite lines of separation lie at the places indicated by the radial arrows 72 in FIG. 5. The sector $A_1$ has an outer connection 61, and the sector $B_1$ has an outer connection 62. The inner counterelectrode arrangement 75 is similarly divided into two semicircular sectors $A_2$ and $B_2$ which have outer connections 63 and 64. The counterelectrode arrangement 76 for the digital display has an outer connection 65 which passes through the line or lines of separation.

By means of a normal and therefore not illustrated drive and control circuit operating on a time multiplex system having a ratio of 1:3, the numerical values illustrated in FIG. 1 can be represented in the following manner by applying voltage to the electrodes:

| Phase | Counter-electrode | Radial elements |
|---|---|---|
| 1 | $A_1 + A_2$ | 5 |
| 2 | $A_2$ | 21 |
| 3 | 76 | 2, 3, 4, 7, 8, 9, 11, 12, 14, 15, 16, 17, 19, 20, 22, 24 |

Referring to FIG. 7, for the analog display of, for example, hours and minutes, a total of 60 strip electrodes are likewise provided within a circle and radially of its center point, but proximity to the center point is greater since the digital display 73 is not arranged within but outside the analog display. Here again, the radial electrodes are divided electrically into two blocks, i.e., a block comprising the electrodes 1 to 30, and a further block comprising the electrodes 31 to 60. FIG. 7 only shows the connecting leads between some of the radial electrodes 31 to 59 and the symbol electrodes of the digital display 73. By means of the lead arrangement illustrated in FIG. 9, the radial electrodes are connected to the control circuit and to each other in the manner described below, so that a parallel circuit is created. The visually undetectable point of separation between the two blocks is in this case substantially horizontally directed and is likewise indicated by the radial arrows 72. Separation is effected between the radial electrodes 30/31 and 60/1.

The outer digital display 73 likewise comprises four places (digits), each of which has seven symbol electrodes. Each of these symbol electrodes is connected by way of exterior leads to one of the radial electrodes 36 to 60 and is electrodes 30 to 60 is electrically in parallel therewith. The arrangement shown in FIG. 7 likewise requires only 30 outer supply leads, only two of which are not connected to the digital display 73 and are therefore available for further display areas.

The counterelectrode arrangements 74, 75 and 76, corresponding to FIG. 7, are illustrated in FIG. 8. These are also divided into semicircular sectors $A_1$ and $B_1$, and $A_2$ and $B_2$ which have exterior connections 61 to 64. The counterelectrode arrangement 76 is used for the digital display 73 and leads to an outer connection 65. The lines of separation between the individual sectors again correspond to the position of the radial arrows 72 in FIG. 7.

Referring to FIG. 9, which is on a different scale, the 60 strip electrodes 1 to 60 are arranged radially within a circle and about the center point thereof, and in fact above the counterelectrode arrangements 74 and 75. In this arrangement, the radial electrodes 1+60; 2+59; 3+58 . . . 28+33; 29+32; 30+31 are connected in parallel with each other by individual leads which are disposed within the counterelectrode arrangement 75 and extend around each other in substantially U-shaped formations. The counter-electrodes 74 and 75 are divided, in the above-stated manner, into semicircular sectors, with one of which are associated the radial electrodes 1 to 30, while the radial electrodes 31 to 60 are associated with the other sector. The line of separation between the individual blocks 1 to 30 and 31 to 60 extends along the dot-dashed diametric line as in FIG. 8. Whereas the outer ends of the radial electrodes 1 to 30 lead to corresponding outer connections, the outer ends of the radial electrodes 31 to 60 are connected, by way of leads, not illustrated, to the digital display disposed outside the analog display (FIGS. 7 and 8).

The term "analog display" will also be understood to include a quasi-analog display, i.e., a display having a stepping switching system as present in the described embodiment.

What is claimed is:

1. In a display for an electronic chronometer having an analog electro-optical display comprising a plurality of segment electrodes radially disposed about a center point and at least one first counterelectrode bridging at least two radial segment electrodes and a digital electro-optical display comprising a plurality of digit electrodes which define at least one alphanumeric character and at least one second counterelectrode, the improvement wherein at least two first counterelectrodes each has a different set of radial segment electrodes associated therewith and means electrically connecting at least one radial segment electrode of one set in parallel with one radial segment electrode of the other set and in parallel with one digit electrode, whereby the display may be driven in a time multiplex manner with a minimum number of external display connections.

2. The display according to claim 1, the first counterelectrodes are configured as two concentric circles each divided into at least two equalized sectors having the same angular position.

3. The display according to claim 1, wherein diametrically opposed radial segment electrodes are electrically connected in parallel.

4. The display according to claim 3, wherein the connecting means is disposed outside the area defined by the radial segment electrodes.

5. The display according to claim 1, wherein the digital display is disposed within the radial segment electrodes of the analog display.

6. The display according to claim 1, wherein the digital display is disposed outside the area defined by the radial segment electrodes of the analog display.

7. The display according to claim 1, wherein the radial electrodes 1, 2, 3 . . . 2n are connected in parallel in the sequence 1+2n; 2+(2n-1); . . . n+(n+1); (n-1)+(n+2) . . .; and wherein the connecting means includes connections within the area defined by the radial segment electrodes extend around one another in a substantially U-shaped configuration.

8. The display according to claim 1, wherein the digit electrodes are connected in parallel exclusively with radial segment electrodes of one set.

9. The display according to claim 1 or claim 3, the digit electrodes are connected in parallel with radial segment electrodes which are disposed within a group of "n" consecutive radial segment electrodes, wherein n is the total number of radial segment electrodes divided by the number of sets.

* * * * *